US009888325B2

(12) United States Patent
Diamond et al.

(10) Patent No.: US 9,888,325 B2
(45) Date of Patent: Feb. 6, 2018

(54) DOPED SUBSTRATE REGIONS IN MEMS MICROPHONES

(71) Applicant: Robert Bosch GmbH, Stuttgart, DE (US)

(72) Inventors: Brett Mathew Diamond, Pittsburgh, PA (US); John M. Muza, Venetia, PA (US); John W. Zinn, Canonsburg, PA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/129,572

(22) PCT Filed: Mar. 31, 2015

(86) PCT No.: PCT/US2015/023587

§ 371 (c)(1),
(2) Date: Sep. 27, 2016

(87) PCT Pub. No.: WO2015/153608

PCT Pub. Date: Oct. 8, 2015

(65) Prior Publication Data

US 2017/0180869 A1 Jun. 22, 2017

Related U.S. Application Data

(60) Provisional application No. 61/973,507, filed on Apr. 1, 2014.

(51) Int. Cl.
*H04R 25/00* (2006.01)
*H04R 19/00* (2006.01)
(Continued)

(52) U.S. Cl.
CPC ..... *H04R 19/005* (2013.01); *H04R 1/04* (2013.01); *H04R 19/04* (2013.01); *H04R 31/003* (2013.01);
(Continued)

(58) Field of Classification Search
CPC ..... H04R 19/005; H04R 19/04; H04R 1/04; H04R 31/003; H04R 31/006; H04R 2201/003
(Continued)

(56) References Cited

U.S. PATENT DOCUMENTS 5,452,268 A * 9/1995 Bernstein ..... H04R 19/005 367/181
5,773,728 A 6/1998 Tsukada et al.
(Continued)

FOREIGN PATENT DOCUMENTS

WO 2007/004119 1/2007
WO 2008/044910 4/2008

OTHER PUBLICATIONS

International Search Report and Written Opinion for Application No. PCT/US2015/023587 dated May 22, 2015 (10 pages).

*Primary Examiner* — Sunita Joshi
(74) *Attorney, Agent, or Firm* — Michael Best & Friedrich LLP

(57) ABSTRACT

Systems and methods for preventing electrical leakage in a MEMS microphone. In one embodiment, the MEMS microphone includes a semiconductor substrate, an electrode, a first insulation layer, and a doped region. The first insulation layer is formed between the electrode and the semiconductor substrate. The doped region is implanted in at least a portion of the semiconductor substrate where the semiconductor substrate is in contact with the first insulation layer. The doped region is also electrically coupled to the electrode.

18 Claims, 12 Drawing Sheets

(51) Int. Cl.
*H04R 19/04* (2006.01)
*H04R 1/04* (2006.01)
*H04R 31/00* (2006.01)

(52) U.S. Cl.
CPC ..... *H04R 31/006* (2013.01); *H04R 2201/003* (2013.01)

(58) Field of Classification Search
USPC ..... 381/173–175; 257/704, 723, 724, 731, 257/774, 782, 415–418
See application file for complete search history.

(56) References Cited

U.S. PATENT DOCUMENTS

| | | | |
|---|---|---|---|
| 5,888,845 | A | 3/1999 | Bashir et al. |
| 6,667,189 | B1 | 12/2003 | Wang et al. |
| 7,847,359 | B2 | 12/2010 | Yamaoka et al. |
| 8,098,870 | B2 | 1/2012 | Kok et al. |
| 8,492,855 | B2 | 7/2013 | Lammel et al. |
| 2011/0147864 | A1 | 6/2011 | Kramer et al. |
| 2012/0091529 | A1 | 4/2012 | Cheng et al. |

* cited by examiner

PRIOR ART

PRIOR ART

DOPED SUBSTRATE REGIONS IN MEMS MICROPHONES

RELATED APPLICATIONS

This application claims priority to U.S. Provisional Application No. 61/973,507, filed on Apr. 1, 2014 and titled "DOPED SUBSTRATE REGIONS IN MEMS MICROPHONES," the entire contents of which is incorporated by reference.

BACKGROUND

Embodiments of the invention relate to preventing electrical leakage between a semiconductor substrate and an electrode in a MEMS microphone.

In a MEMS microphone, the overlap of an electrode (e.g., moveable membrane, stationary front plate) and a semiconductor substrate creates a susceptibility to electrical leakage from non-insulating particles (or other forms of leakage) that come into contact with the surfaces of both components. Insulating protection coatings are typically applied to MEMS microphones to prevent electrical leakage/shorts. However, conductive paths, caused by non-insulating particles, can be created during the manufacturing process prior to deposition of any coatings.

SUMMARY

One embodiment of the invention provides a MEMS microphone. The MEMS microphone includes a semiconductor substrate, an electrode, a first insulation layer, and a doped region. The doped region is implanted in at least a portion of the semiconductor substrate where the semiconductor substrate is in contact with the first insulation layer. The doped region is electrically coupled to the electrode. In some implementations, the semiconductor substrate includes N-type majority carriers and the doped region includes P-type majority carriers. In other implementations, the semiconductor substrate includes P-type majority carriers and the doped region includes N-type majority carriers. In some implementations, the electrode includes at least one type of electrode selected from a group consisting of a moveable electrode and a stationary electrode. In some implementations, the MEMS microphone further includes an application specific integrated circuit. In some implementations, the doped region is electrically coupled to the application specific integrated circuit. In other implementations, the doped region is electrically coupled to an application specific integrated circuit that is external to the MEMS microphone.

In another embodiment, a MEMS microphone with two insulation layers is provided. In one example, the MEMS microphone includes a semiconductor substrate, an electrode, a first insulation layer, a doped region, and a second insulation layer. The doped region is implanted in at least a portion of the semiconductor substrate where the semiconductor substrate is in contact with the first insulation layer. The doped region is electrically coupled to the electrode. The second insulation layer is formed between the semiconductor substrate and the doped region. The doped region includes a first plurality of majority carriers and the semiconductor substrate includes a second plurality of majority carriers. The first plurality of majority carriers and the second plurality of majority carriers include at least one type of majority carriers selected from a group consisting of P-type majority carriers and N-type majority carriers. In some implementations, the first plurality of majority carriers is a same type of majority carriers as the second plurality of majority carriers. In other implementations, the first plurality of majority carriers is a different type of majority carriers than the second plurality of majority carriers.

The invention further provides a method for preventing electrical leakage in a MEMS microphone. In one embodiment, the method includes forming a first insulation layer between a semiconductor substrate and an electrode. The method also includes implanting a doped region into the semiconductor substrate such that the doped region is provided in at least a portion of the semiconductor substrate where the semiconductor substrate is in contact with the first insulation layer. The method further includes electrically coupling the electrode to the doped region. In some implementations, the method also includes implanting P-type majority carriers into the doped region and N-type majority carriers into the semiconductor substrate. In other implementations, the method also includes implanting N-type majority carriers into the doped region and P-type majority carriers into the semiconductor substrate. In some implementations, the electrode includes at least one type of electrode selected from a group consisting of a moveable electrode and a stationary electrode. In some implementations, the method further includes electrically coupling the doped region to an application specific integrated circuit that is internal to the MEMS microphone. In other implementations, the method further includes electrically coupling the doped region to an application specific integrated circuit that is external to the MEMS microphone.

In another embodiment, the invention also provides a method for preventing electrical leakage in a MEMS microphone using, among other things, two insulation layers. In one example, the method includes forming a first insulation layer between a semiconductor substrate and an electrode. The method also includes implanting a doped region into the semiconductor substrate such that the doped region is provided in at least a portion of the semiconductor substrate where the semiconductor substrate is in contact with the first insulation layer. The method further includes electrically coupling the electrode to the doped region. The method also includes forming a second insulation layer between the semiconductor substrate and the doped region. In some implementations, the method further includes implanting a first plurality of majority carriers into the doped region and a second plurality of majority carriers into the semiconductor substrate. The first plurality of majority carriers and the second plurality of majority carriers include at least one type of majority carriers selected from a group consisting of P-type majority carriers and N-type majority carriers. In some implementations, the first plurality of majority carriers is a same type of majority carriers as the second plurality of majority carriers. In other implementations, the first plurality of majority carriers is a different type of majority carriers than the second plurality of majority carriers.

Other aspects of the invention will become apparent by consideration of the detailed description and accompanying drawings.

DETAILED DESCRIPTION

Figure 1:
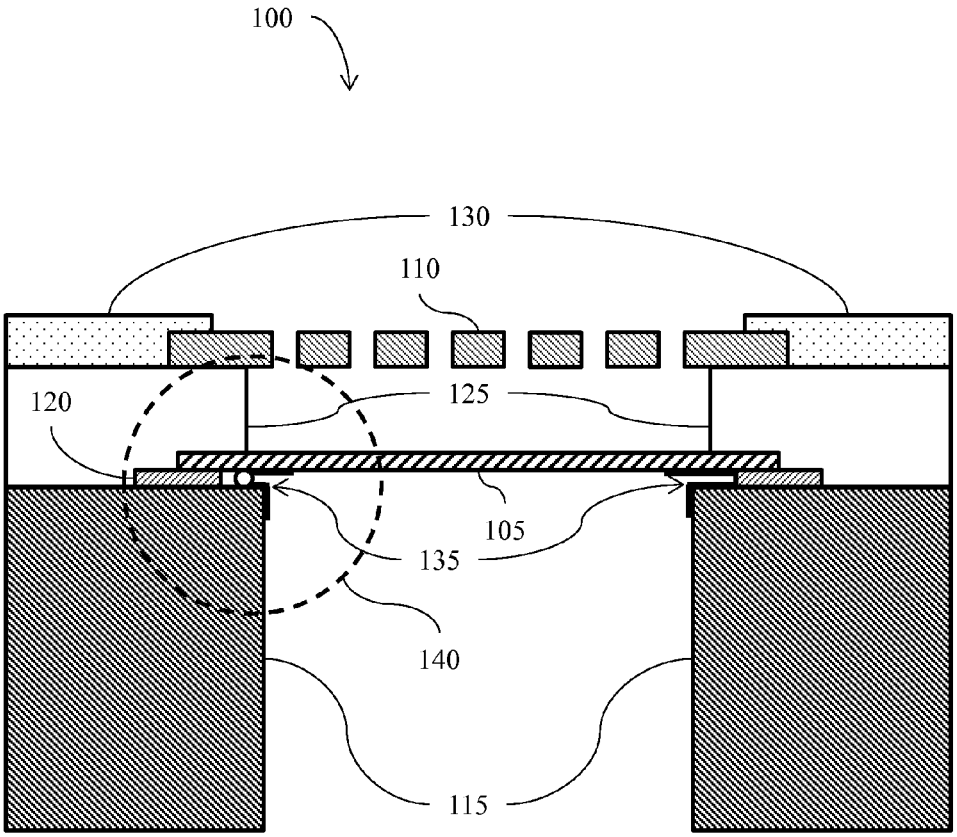
FIG. 1 is a cross-sectional side view of a conventional MEMS microphone.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

It should also be noted that a plurality of different structural components may be utilized to implement the invention. Furthermore, and as described in subsequent paragraphs, the specific configurations illustrated in the drawings are intended to exemplify embodiments of the invention. Alternative configurations are possible.

FIG. 1 illustrates a conventional MEMS microphone 100. The conventional MEMS microphone 100 includes a moveable electrode 105 (e.g., membrane), a stationary electrode 110 (e.g., front plate), a semiconductor substrate 115, a first insulation layer 120, a second insulation layer 125, and a third insulation layer 130. The moveable electrode 105 overlaps the semiconductor substrate 115. This overlaps creates a gap 135 between the moveable electrode 105 and the semiconductor substrate 115. The gap 135 creates a susceptibility to electrical leakage from non-insulating particles that come into contact with the surfaces of both components and to or other forms of leakage. Non-insulating particles include, for example, small fragments or thin released beams of silicon from a sidewall of a hole in the semiconductor substrate 115 and organic particles from photoresist that is used in manufacturing the MEMS microphone 100.

Figure 2:
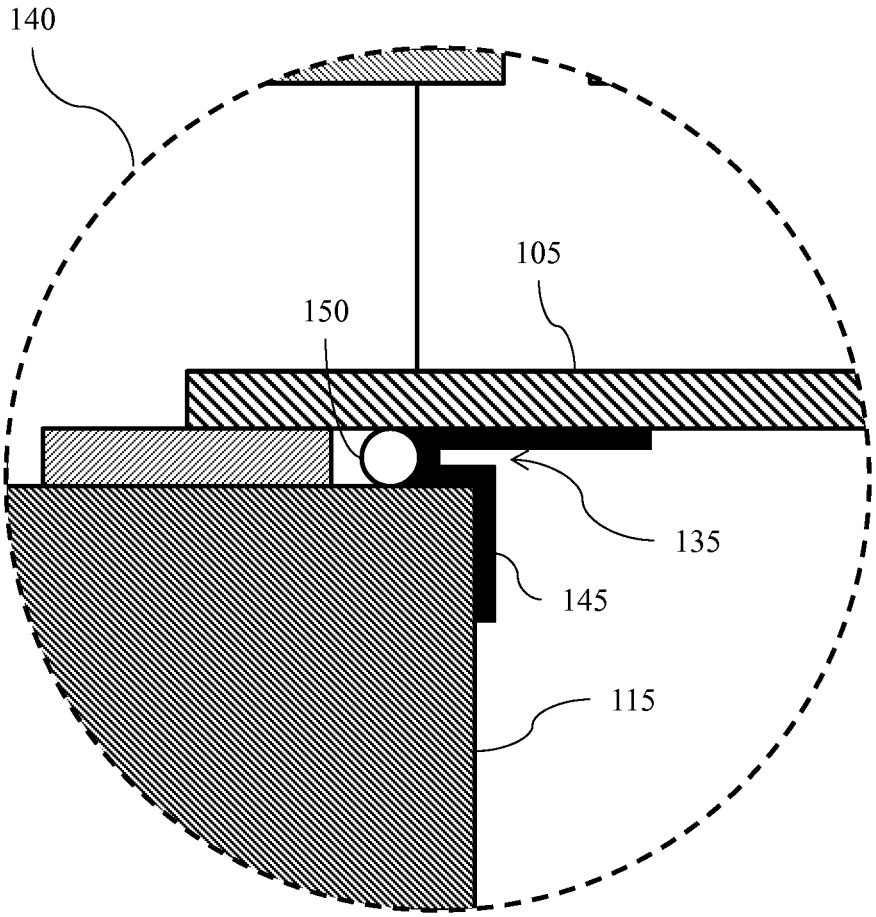
FIG. 2 is enlarged view of an area of FIG. 1.

FIG. 2 is an enlarged view of area 140 in FIG. 1. As illustrated in FIG. 2, an insulating protection coating 145 has been applied to the gap 135. However, a non-insulating particle 150 is caught between the moveable electrode 105 and the semiconductor substrate 115, causing a short.

Figure 3:
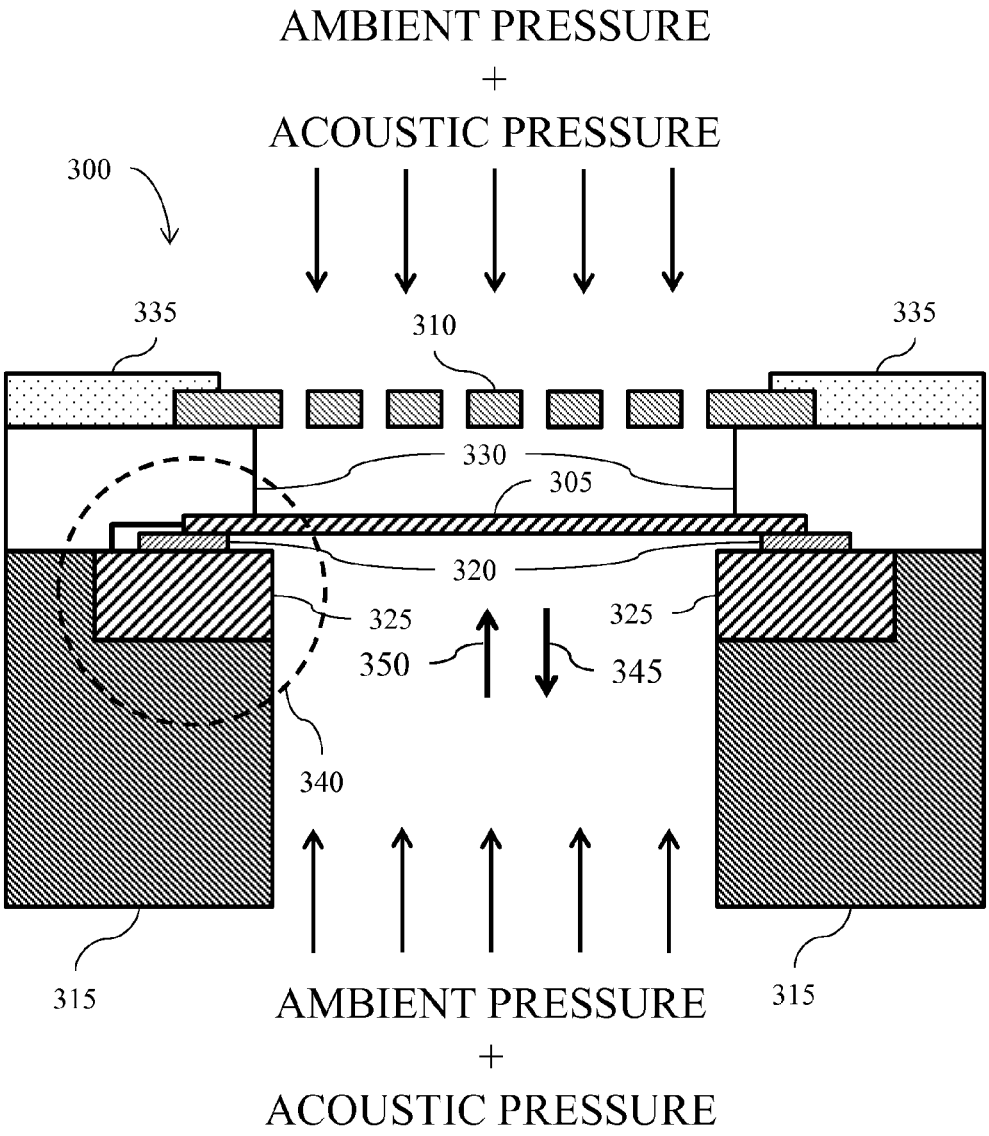
FIG. 3 is a cross-sectional side view of a MEMS microphone including a doped region.

A MEMS microphone 300 includes, among other components, a moveable electrode 305, a stationary electrode 310, a semiconductor substrate 315, a first insulation layer 320, a doped region 325, an inter-metal dielectric ("IMD") layer 330, and a passivation layer 335, as illustrated in FIG. 3. The moveable electrode 305 overlaps the semiconductor substrate 315. The stationary electrode 310 is positioned above the moveable electrode 305. In some implementations, the first insulation layer 320 includes a field oxide. In other implementations, the first insulation layer 320 includes a different type of oxide. For example, the first insulation layer 320 may include a thermal or plasma-based oxide (e.g., low pressure chemical vapor deposition oxide, plasma-enhanced chemical vapor deposition oxide). The IMD layer 330 is positioned between the moveable electrode 305 and the stationary electrode 310. The IMD layer 330 electrically isolates metal lines in a CMOS process. In some implementations, the IMD layer 330 includes un-doped tetraethyl orthosilicate. The passivation layer 335 is positioned adjacent to the IMD layer 330 and is coupled to the stationary electrode 310. The passivation layer 335 protects the oxides from contamination and humidity. Contamination and humidity cause current leakage and degrades the electrical performance of transistors, capacitors, etc. In some implementations, the passivation layer 335 includes silicon nitride. In other implementations, the passivation layer 335 includes silicon dioxide.

Acoustic and ambient pressures acting on the moveable electrode 305 cause movement of the moveable electrode 305 in the directions of arrow 345 and 350. Movement of the moveable electrode 305 relative to the stationary electrode 310 causes changes in a capacitance between the moveable electrode 305 and the stationary electrode 310. This changing capacitance generates an electric signal indicative of the acoustic and ambient pressures acting on the moveable electrode 305.

Figure 4:
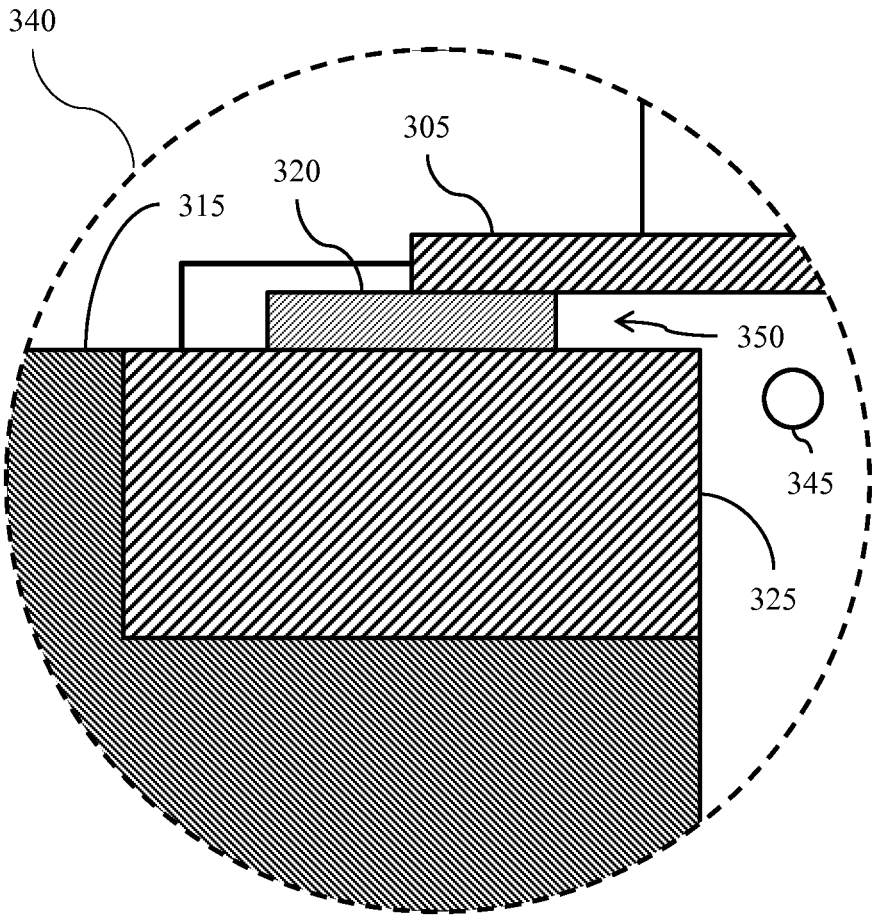
FIG. 4 is enlarged view of an area of FIG. 3.

FIG. 4 is an enlarged view of area 340 in FIG. 3. The doped region 325 is implanted in the semiconductor substrate 315 such that it is in contact with the first insulation layer 320. The doped region 325 is electrically coupled to the moveable electrode 305. The semiconductor substrate 315 contains P-type majority carriers and the doped region 325 contains N-type majority carriers. In some implementations, the doped region 325 contains a concentration of approximately $1\times10^{16}$ $cm^{-3}$ N-type majority carriers. In some implementations, the semiconductor substrate 315 contains N-type majority carriers and the doped region 325 contains P-type majority carriers. In some implementations, the doped region 325 contains a concentration of approximately $1\times10^{16}$ $cm^{-3}$ P-type majority carriers. The doped region 325 prevents a non-insulating particle 345 from creating leakage paths in the gap 350 between the moveable electrode 305 and the semiconductor substrate 315. P-type majority carriers include, for example, boron, aluminum, and any other group III element in the periodic table. N-type majority carriers include, for example, phosphorus, arsenic, and any other group V element in the periodic table.

Figure 5:
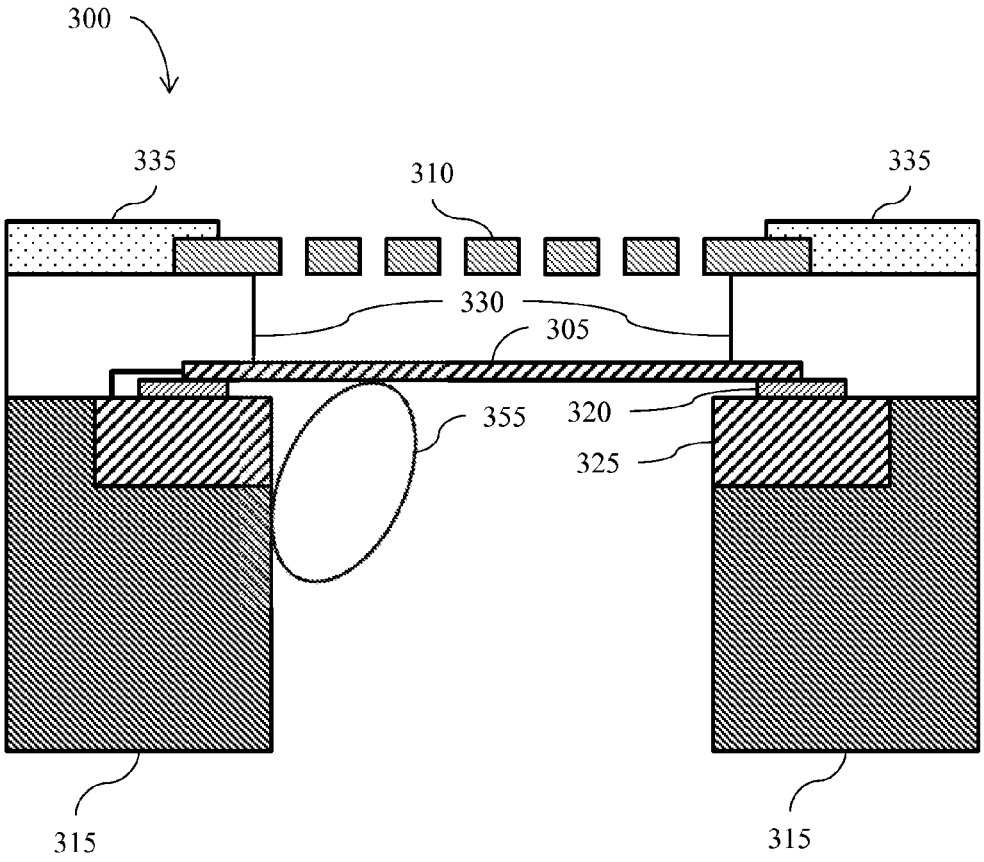
FIG. 5 is a cross-sectional side view of a MEMS microphone including a doped region.

The concentration of majority carriers and the depth of the doped region 325 influences the maximum voltage and non-insulating particle size that the doped region 325 is capable of preventing electrical leakage from. For example, a 12 micrometer deep doped region 325 containing N-type majority carriers is able to prevent up to 100 volts of electrical leakage. In FIG. 4, the size of the non-insulating particle 345 is too small to create a leakage path between the moveable electrode 305 and the semiconductor substrate 315. FIG. 5 illustrates a non-insulating particle 355 that is large enough to create a leakage path between the moveable electrode 305 and the semiconductor substrate 315.

Figure 6:
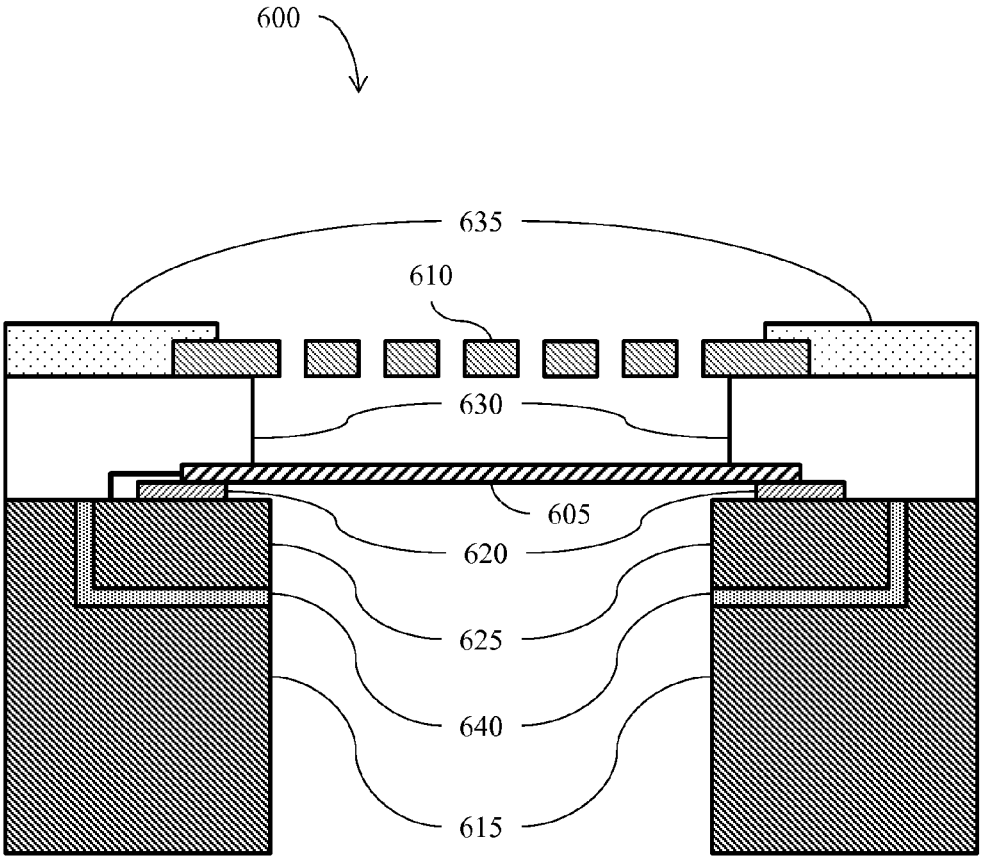
FIG. 6 is a cross-sectional side view of a MEMS microphone including a SOI layer.

In some implementations, a MEMS microphone 600 includes, among other components, a moveable electrode 605, a stationary electrode 610, a semiconductor substrate 615, a first insulation layer 620, a doped region 625, an IMD layer 630, a passivation layer 635, and a second insulation layer 640, as illustrated in FIG. 6. The moveable electrode 605 is electrically coupled to the doped region 625. The first insulation layer 620 includes a field oxide. The second insulation layer includes a silicon-on-insulator ("SOI") wafer. The second insulation layer 640 is deposited between the semiconductor substrate 615 and the doped region 625. The second insulation layer 640 provides electrical isolation between the semiconductor substrate 615 and the doped region 625. Both the semiconductor substrate 615 and the doped region 625 contain P-type majority carriers. In some implementations, both the semiconductor substrate 615 and the doped region 625 contain N-type majority carriers.

Figure 7:
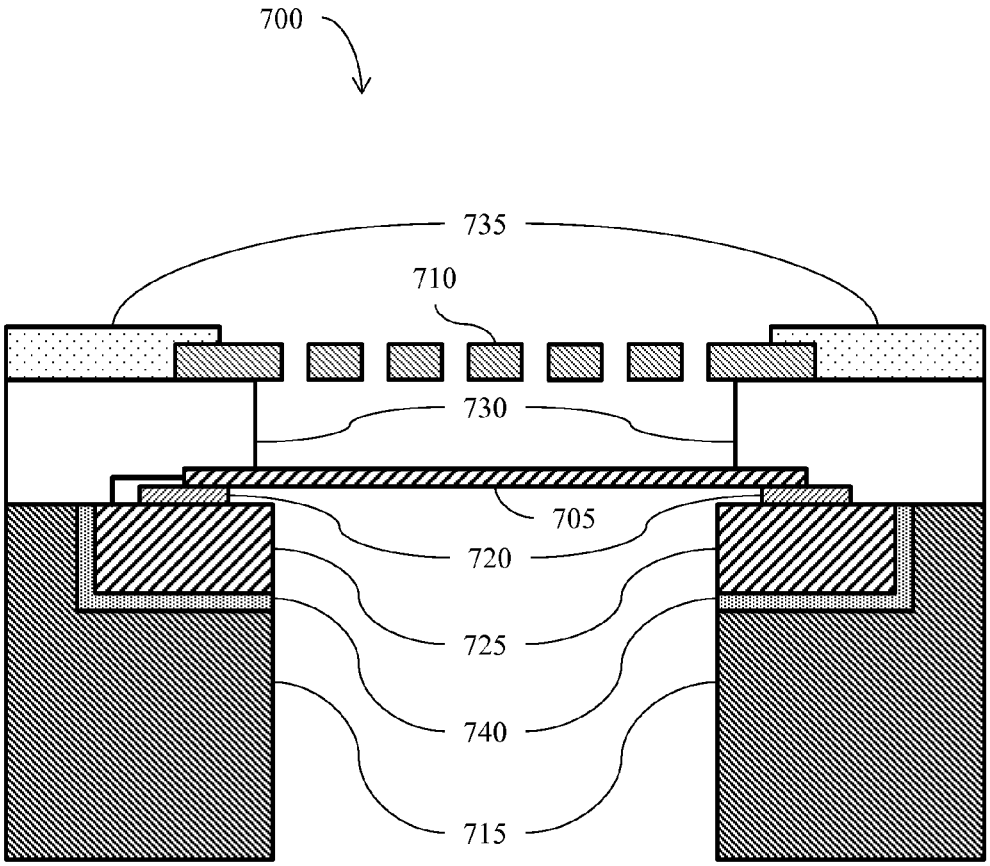
FIG. 7 is a cross-sectional side view of a MEMS microphone including a SOI layer.

In some implementations, a MEMS microphone 700 includes, among other components, a moveable electrode 705, a stationary electrode 710, a semiconductor substrate 715, a first insulation layer 720, a doped region 725, an IMD layer 730, a passivation layer 735, and a second insulation layer 740, as illustrated in FIG. 7. The moveable electrode 705 is electrically coupled to the doped region 725. The first insulation layer 720 includes a field oxide. The second insulation layer 740 includes an SOI wafer. The semiconductor substrate 715 contains P-type majority carriers and the doped region 725 contains N-type majority carriers. In some implementations, the semiconductor substrate 715 contains N-type majority carriers and the doped region 725 contains P-type majority carriers.

Figure 8:
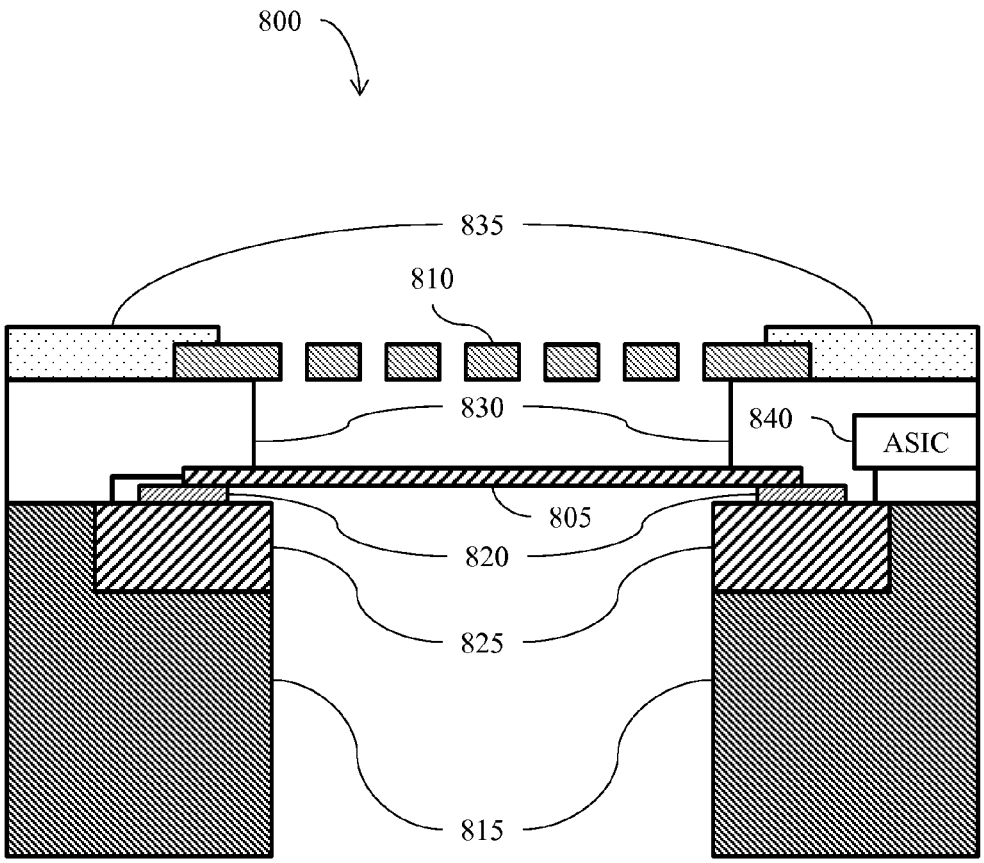
FIG. 8 is a cross-sectional side view of a MEMS microphone including an ASIC.
Figure 9:
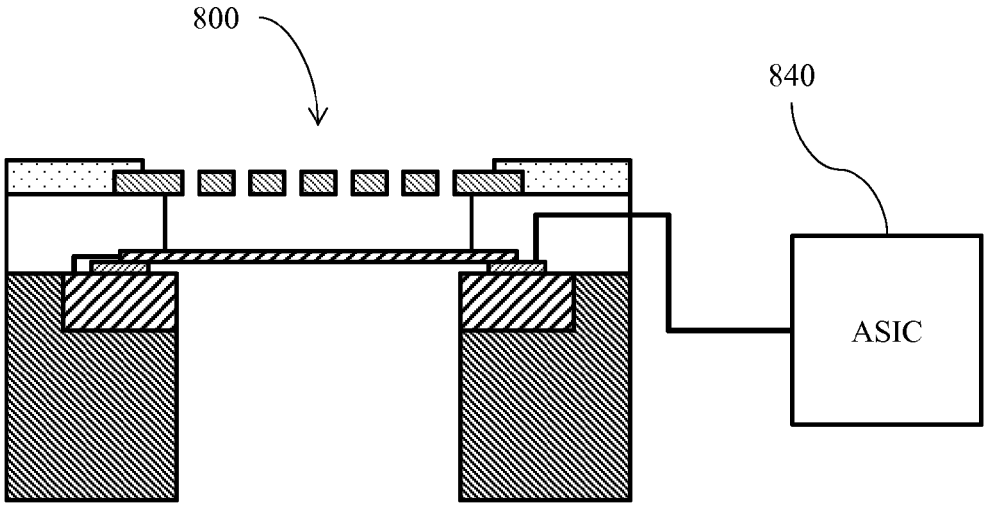
FIG. 9 is a system level view of a MEMS microphone and an ASIC.

In some implementations, a MEMS microphone 800 includes, among other components, a moveable electrode 805, a stationary electrode 810, a semiconductor substrate 815, a first insulation layer 820, a doped region 825, an IMD layer 830, a passivation layer 835, and an application specific integrated circuit ("ASIC") 840, as illustrated in FIG. 8. The moveable electrode 805 is electrically coupled to the doped region 825. The first insulation layer 820 includes a field oxide. The ASIC 840 is integrated into the MEMS microphone 800, for example, in the IMD layer 830. The ASIC 840 is electrically coupled to the doped region 825. The doped region 825 can introduce parasitics (e.g., capacitance) between the doped region 825 and the semiconductor substrate 815. In some implementations, the ASIC 840 is configured to support the added parasitics. In some implementations, the ASIC 840 is separate from the MEMS microphone 800, as illustrated in FIG. 9.

Figure 10:
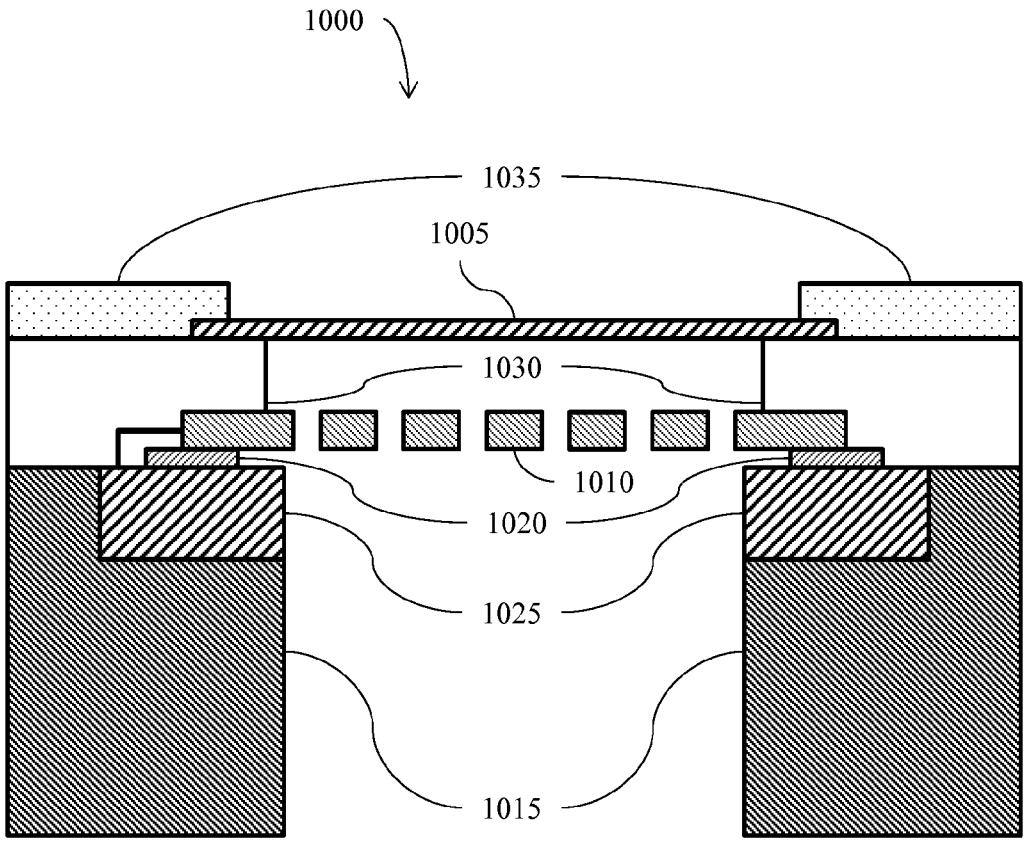
FIG. 10 is a cross-sectional side view of a MEMS microphone including a doped region.

In some implementations, a MEMS microphone 1000 includes, among other components, a moveable electrode 1005, a stationary electrode 1010, a semiconductor substrate 1015, a first insulation layer 1020, a doped region 1025, an IMD layer 1030, and a passivation layer 1035, as illustrated in FIG. 10. The first insulation layer 1020 includes a field oxide. The stationary electrode 1010 overlaps the semiconductor substrate 1015. The moveable electrode 1005 is positioned above the stationary electrode 1010. The stationary electrode 1010 is electrically coupled to the doped region 1025. The IMD layer 1030 is positioned between the moveable electrode 1005 and the stationary electrode 1010. The passivation layer 1035 is positioned adjacent to the IMD layer 1030 and is coupled to the moveable electrode 1005. The semiconductor substrate 1015 contains P-type majority carriers and the doped region 1025 contains N-type majority carriers. In some implementations, the semiconductor substrate 1015 contains N-type majority carriers and the doped region 1025 contains P-type majority carriers.

Figure 11:
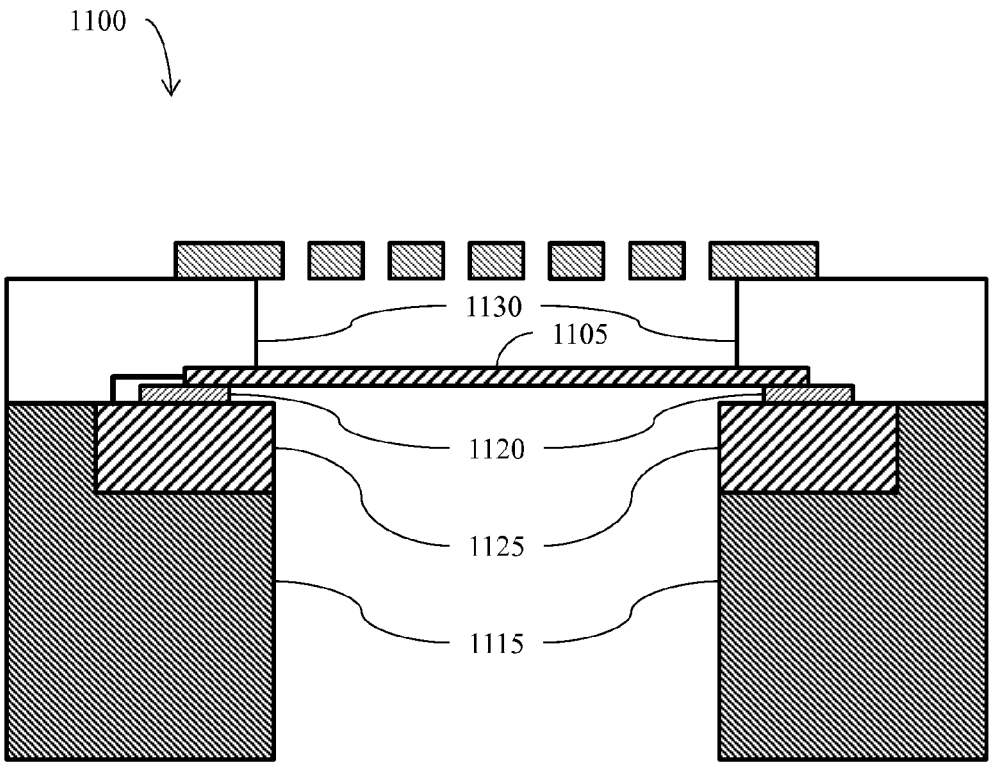
FIG. 11 is a cross-sectional side view of a MEMS microphone including a doped region.

The MEMS microphones discussed above are designed for ASIC processes. Doped regions may also be used in a MEMS microphone 1100 designed for a non-ASIC process. In some implementations, the MEMS microphone 1100 includes, among other components, a moveable electrode 1105, a stationary electrode 1110, a semiconductor substrate 1115, a first insulation layer 1120, a doped region 1125, and an IMD layer 1130, as illustrated in FIG. 11. The moveable electrode 1105 is electrically coupled to the doped region 1125. In some embodiments, the first insulation layer 1120 includes a field oxide. In other embodiments, the first insulation layer 1120 includes, for example, a different type of oxide, or a type of nitride. The moveable electrode 1105 overlaps the semiconductor substrate 1115. The stationary electrode 1110 is positioned above the moveable electrode 1105. The IMD layer 1130 is positioned between the moveable electrode 1105 and the stationary electrode 1110. The IMD layer 1130 includes, for example, silicon oxide or nitride.

Figure 12:
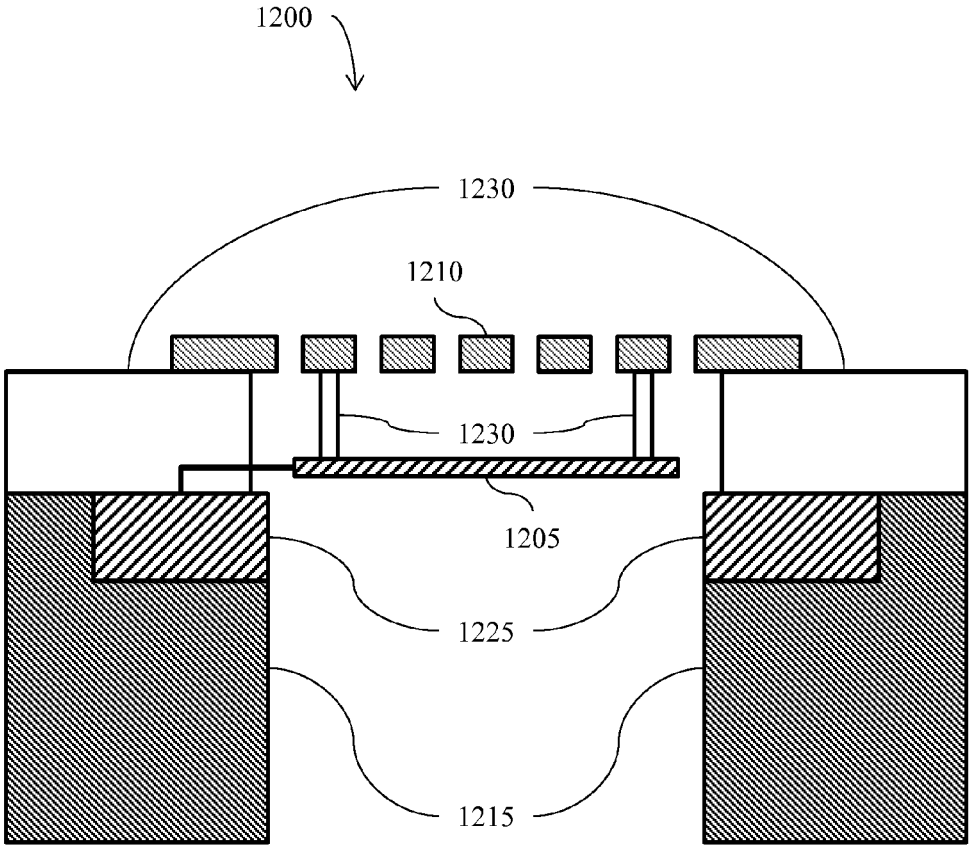
FIG. 12 is a cross-sectional side view of a MEMS microphone including a doped region.

In some implementations, the MEMS microphone 1200 includes, among other components, a moveable electrode 1205, a stationary electrode 1210, a semiconductor substrate 1215, a doped region 1225, and an IMD layer 1230, as illustrated in FIG. 12. The moveable electrode 1205 does not overlap the semiconductor substrate 1215. The moveable electrode 1205 is electrically coupled to the doped region 1205. The stationary electrode 1210 is positioned above the moveable electrode 1205. The IMD layer 1230 is positioned between the moveable electrode 1205 and the stationary electrode 1210. The moveable electrode 1205 is physically coupled to the stationary electrode 1210 via the IMD layer 1230. The IMD layer 1230 electrically isolates the moveable electrode 1205 from the stationary electrode 1210. In some implementations, the IMD layer 1230 includes un-doped tetraethyl orthosilicate. In other implementations, the IMD layer 1230 includes, for example, silicon oxide or nitride.

Thus, the invention provides, among other things, systems and methods of preventing electrical leakage in MEMS microphones. Various features and advantages of the invention are set forth in the following claims.

What is claimed is:

1. A MEMS microphone comprising:

a semiconductor substrate;

an electrode;

a first insulation layer, the first insulation layer formed between the electrode and the semiconductor substrate;

a doped region, the doped region implanted in at least a portion of the semiconductor substrate; and a second insulation layer is formed between the semiconductor substrate and the doped region, wherein the semiconductor substrate is in contact with the first insulation layer, and the doped region is electrically coupled to the electrode.

2. The MEMS microphone according to claim 1, wherein the doped region includes P-type majority carriers and the semiconductor substrate includes N-type majority carriers.

3. The MEMS microphone according to claim 1, wherein the doped region includes N-type majority carriers and the semiconductor substrate includes P-type majority carriers.

4. The MEMS microphone according to claim 1, wherein the doped region includes a first plurality of majority carriers and the semiconductor substrate includes a second plurality of majority carriers, and wherein the first plurality of majority carriers and the second plurality of majority carriers include at least one type of majority carriers selected from a group consisting of P-type majority carriers and N-type majority carriers.

5. The MEMS microphone according to claim 4, wherein the first plurality of majority carriers is a same type of majority carriers as the second plurality of majority carriers.

6. The MEMS microphone according to claim 4, wherein the first plurality of majority carriers is a different type of majority carriers than the second plurality of majority carriers.

7. The MEMS microphone according to claim 1, wherein the electrode includes at least one type of electrode selected from a group consisting of a moveable electrode and a stationary electrode.

8. The MEMS microphone according to claim 1, further comprising an application specific integrated circuit, wherein the doped region is electrically coupled to the application specific integrated circuit.

9. The MEMS microphone according to claim 1, wherein the doped region is electrically coupled to an application specific integrated circuit that is external to the MEMS microphone.

10. A method for preventing electrical leakage in a MEMS microphone, the method comprising:

forming a first insulation layer between a semiconductor substrate and an electrode;

implanting a doped region into the semiconductor substrate such that the doped region is provided in at least a portion of the semiconductor substrate where the semiconductor substrate is in contact with the first insulation layer;

forming a second insulation layer between the semiconductor substrate and the doped region; and electrically coupling the electrode to the doped region.

11. The method according to claim 10, further comprising implanting P-type majority carriers into the doped region and N-type majority carriers into the semiconductor substrate.

12. The method according to claim 10, further comprising implanting N-type majority carriers into the doped region and P-type majority carriers into the semiconductor substrate.

13. The method according to claim 10, further comprising implanting a first plurality of majority carriers into the doped region and a second plurality of majority carriers into the semiconductor substrate, wherein the first plurality of majority carriers and the second plurality of majority carriers include at least one type of majority carriers selected from a group consisting of P-type majority carriers and N-type majority carriers.

14. The method according to claim 13, wherein the first plurality of majority carriers is a same type of majority carriers as the second plurality of majority carriers.

15. The method according to claim 13, wherein the first plurality of majority carriers is a different type of majority carriers than the second plurality of majority carriers.

16. The method according to claim 10, wherein the electrode includes at least one type of electrode selected from a group consisting of a moveable electrode and a stationary electrode.

17. The method according to claim 10, further comprising electrically coupling the doped region to an application specific integrated circuit that is internal to the MEMS microphone.

18. The method according to claim 10, further comprising electrically coupling the doped region to an application specific integrated circuit that is external to the MEMS microphone.

* * * * *